United States Patent [19]

Dowd

[11] 4,103,840

[45] Aug. 1, 1978

[54] STRETCHABLE MATERIAL REWINDING MACHINE

[75] Inventor: Daniel J. Dowd, Williamsport, Pa.

[73] Assignee: Westvaco Corporation, New York, N.Y.

[21] Appl. No.: 750,469

[22] Filed: Dec. 14, 1976

[51] Int. Cl.[2] ..... B65H 25/22

[52] U.S. Cl. ..... 242/67.3 R; 242/66; 242/75.1; 242/75.5

[58] Field of Search ..... 242/75.5, 75.51, 75.1, 242/75.52, 75.53, 67.3 R, 67.2, 66, 65

[56] References Cited

U.S. PATENT DOCUMENTS

| | | | |
|---|---|---|---|
| 2,753,128 | 7/1956 | Thomas et al. | 242/75.5 |
| 3,239,161 | 3/1966 | Dutro et al. | 242/75.5 X |
| 3,746,278 | 7/1973 | Dennis et al. | 242/75.51 X |

*Primary Examiner*—Harvey C. Hornsby
*Assistant Examiner*—John M. Jillions
*Attorney, Agent, or Firm*—W. Allen Marcontell; Richard L. Schmalz

[57] ABSTRACT

Web tension in a creped paper rewinder is controlled at two stations along the web route by respective counterweighted dancer rolls which also serve as sensors for a drive speed control mechanism. Primary drive speed is under programmed control whereby a first, length percentage of a rewind reel length determines the high speed drive duration whereupon the drive speed is reduced to a lower rate for rewind reel length completion. Rewind reels are self-started on vacuum mandrels which are magazine supplied to the reel starting position. The supply web is longitudinally slit into a multiplicity of strips, each strip being wound about the vacuum mandrel in a reel laterally distinct from adjacent reels but with all reels built upon a common axis mandrel. Tails of the several strips are severed from the web supply by traversing cutter-gluer apparatus which simultaneously spots the end of each cut tail with a portion of adhesive to prevent unreeling following strip reel removal from the mandrel.

4 Claims, 1 Drawing Figure

STRETCHABLE MATERIAL REWINDING MACHINE

BACKGROUND OF THE INVENTION

1. Field of the Invention

The present invention relates to the conversion of highly stretchable web and film materials from large supply reels to a multiplicity of smaller reels. More specifically, the present invention relates to creped paper rewinding machines.

2. Description of the Prior Art

Creped paper as is used for decorative and display purposes is most efficiently manufactured in web widths of approximately five feet or greater and in reel handled lengths of two thousand feet or greater. However, one of the greater uses of crepe paper is for decorative streamers which require dimensions of 1½ to 4 inches of width and twenty to five-hundred feet of length. Accordingly, 5 foot wide reels of the material are converted to a multiplicity of streamer size reels by a machine conducted process of longitudinally slitting a full width web as it is unwound from a reel into a plurality of streamer width strips and simultaneously rewinding such streamers on separate, narrow reels. Intermittently, the unwinding-slitting-rewinding process is stopped to transversely sever the streamer length from the oncoming web supply and remove the resulting, small, rewound reels.

Although some fabrics and plastic films are similar to crepe paper in the characteristics of tensile elongation, crepe paper is somewhat unique in the low value and nature of this characteristic. Consequently, converting and rewinding machines adapted to handle creped paper must have extremely sensitive tension controls. This necessity is further complicated by intermittent running cycles which impose wide range acceleration loads on the web.

The prior art is crowded with techniques of web tension control in various, continuous feed machines. The following U.S. Patents are representative of the scope of such techniques U.S. Pat. Nos: 3,214,110; 3,419,771; 3,589,578; 3,746,271; 3,780,961; and 3,927,844.

A freqently used feature of many prior art tension control systems is direct speed control over the primary machine power source. Another and older technique of tension control is the use of spring tensioned dancer rolls. Each of these techniques have respective advantages and disadvantages. For example, the familiar dancer roll technique is mechanically simple and operatively reliable but has limited response capacity. A sustained excess tension load on the web will move the dancer roll to the limit of traveling capacity whereupon the load will be transmitted past the dancer roll station.

Web tension control systems which act directly on the machine drive have considerable response scope for correction of long duration tension changes but also have relatively slow response times. Also, the load sensory and signal translation schemes are complicated and often unreliable.

It is, therefore, an objective of the present invention to provide a tension control system suitable for crepe paper rewinding having both rapid and sustained response capacity.

Another object of the present invention is to teach a rewind reel starting system having an automatic feed of empty mandrels to the rewinding station.

Another object of the present invention is to teach a semi-automatic strip end-tail cutting mechanism that simultaneously spots each end-tail with adhesive to hold each streamer reel firmly together following removal from the rewinding mandrel.

Another object of the present invention is to teach a dancer roll tension response system wherein the dancer roll constitutes a tension monitoring sensor for a speed control system.

Another object of the present invention is to teach a system for automatic two-speed control over the primary drive power source that is responsive to the rewind streamer length.

SUMMARY OF THE INVENTION

These and other objectives are accomplished by a rewinding machine having two counterweighted dancer rolls between the unwind and rewind stations. Tension variations in the crepe paper web applied to the first dancer roll causes an immediate, corresponding displacement of the first dancer roll to effect a web route length change. Simultaneously, such displacement of the dancer roll initiates the shift of an infinitely variable transmission link between the primary drive motor and the supply reel unwind drive train.

The second tension controlling dancer roll is positioned in the web course immediately prior to the rewind station. Displacement of the second dancer roll initiates a variable transmission speed shift in the drive train to an S-wrap web guide roll cluster.

Streamer end cutting is performed by a pressure loaded disc knife mounted on a rigid frame guided traversing carriage. Alongside the knife is a pulse actuated, pressurized adhesive applicator. Adjustable abutment means are provided along the length of the carriage guide frame to initiate glue ejection pulses at positional interims corresponding to individual streamer spacing across the machine width Streamer winding is built upon a hollow, perforated, cylindrical mandrel having at least one open end to communicate with a vaccum duct in alignment with the streamer reel starting position.

A number of similar mandrels are magazine loaded to be gravity fed to the reel starting position which is in alignment with the vacuum duct.

Manual or automatic cycling of a bellcrank mechanism controls the mandrel magazine feed rate and deposits a single empty mandrel in the reel starting position when desired.

BRIEF DESCRIPTION OF THE DRAWING

Relative to the drawing wherein like reference characters throughout the several figures of the drawing designate like or similar elements.

DESCRIPTION OF THE PREFERRED EMBODIMENT

Figure 1:
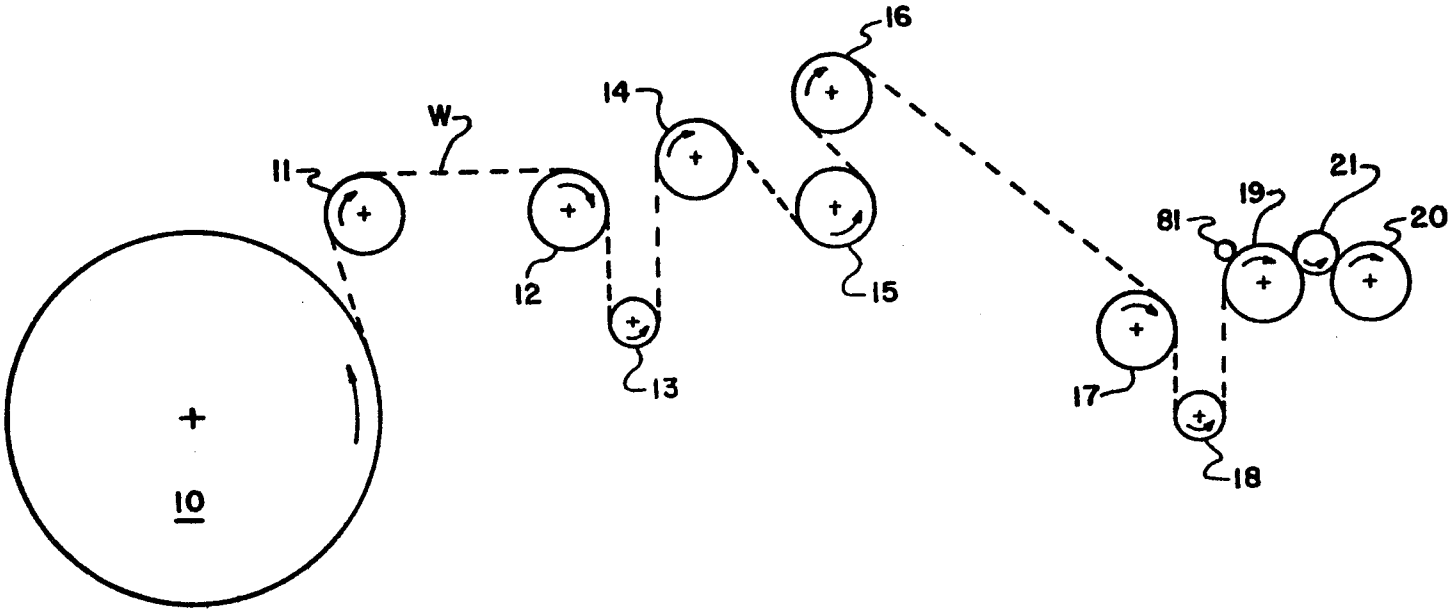
FIG. 1 is a routing schematic of the web path through the present machine.

The general layout of FIG. 1 shows a supply reel 10 of the web or film material to be cut and rewound with the web route W passing over guide rolls 11, 12, 14, 15, 16 and 17. Rolls 13 and 18 are web tension control dancer rolls. Rolls 19 and 20 are surface driving rolls for an axial row of individual reels 21 wound from strips of the web supply. Such strips result from a longitudinal severance of the web W as it is drawn under slitter knives 81 which roll in slight pressing contact with the surface of roll 19.

Mechanical Drive

Figure 2:
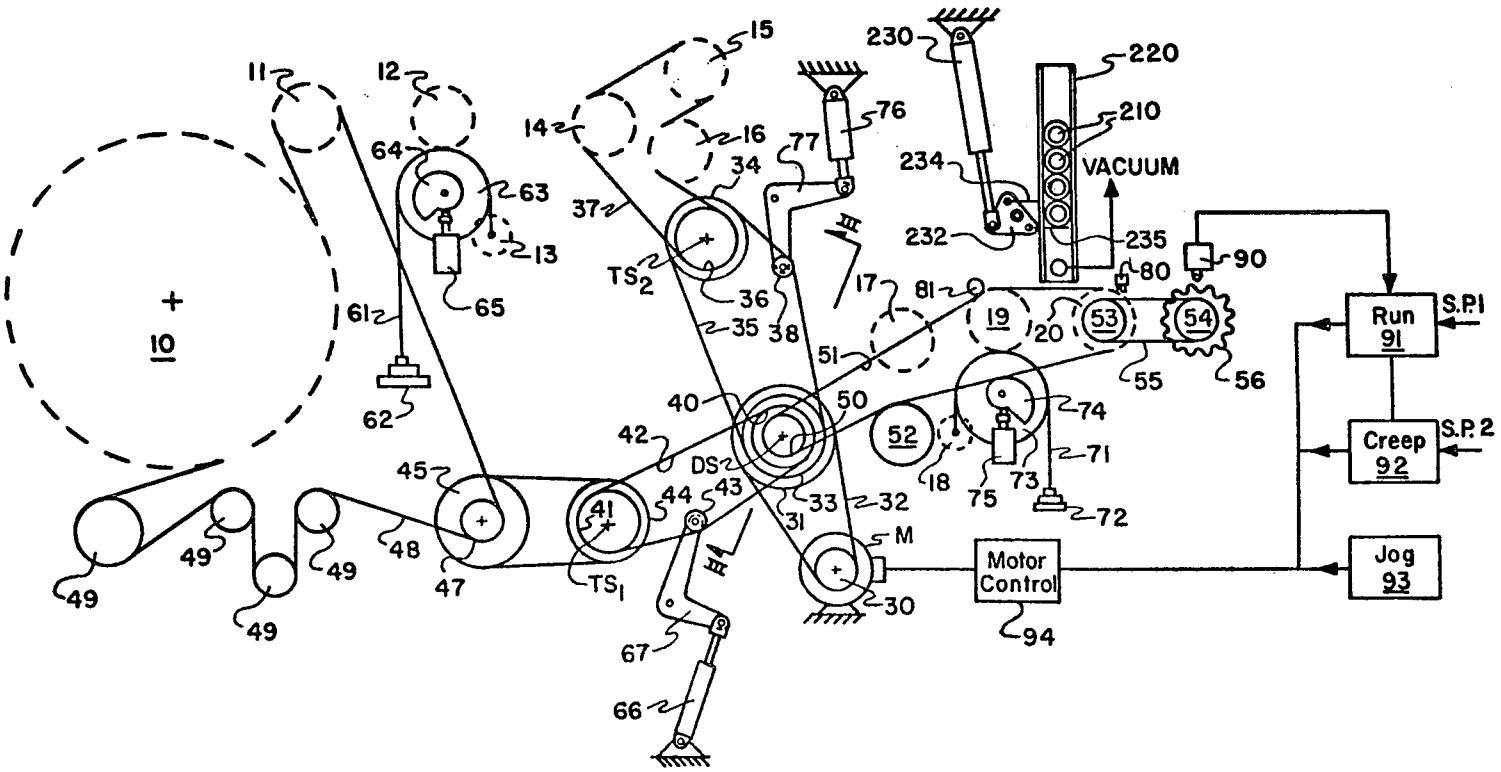
FIG. 2 is a power transmission schematic for the several roll elements of the present machine including an electrical schematic of the primary motor speed control.

The mechanical drive layout of FIG. 2 shows the guide and dancer rolls of FIG. 1 in dashed lines and in solid lines shows the power transmission link therebetween.

Primary drive power for the machine is derived from motor M, sheave 30 and belt 32. Sheave 31, driven by belt 32, is secured to drive shaft DS as is best seen from FIG. 3. Shaft DS, consequently, transmits rotary drive power to driving sheaves 33, 40 and 50.

Linking the drive sheave 40 to driven transmission sheave 41 is a belt 42 having a variable length running periphery passing over a shifting roller 43. Secured to the same transfer shaft $TS_1$, as seen from FIG. 3 to carry transmission sheave 41 but on the opposite machine side, is another drive sheave 44 for belt 46. Sheave 45, driven by belt 46, is rotatively secured to drive roll 47 for driving belt 48. Web supporting belt 48 passes around a portion of the supply roll 10 periphery, over guide rollers 11 and 49 and roll 47 as a surface drive therefor.

Similarly, belt 35 (FIGS. 2 and 3) links drive sheave 33 to transmission sheave 34 with a variable periphery set by shifting roller 38. Transmission sheave 34 is secured to a second transfer shaft $TS_2$ which also carries sheave 36 to drive belt 37. Guide rolls 14, 15 and 16 are provided with appropriate sheaves to be driven by belt 37.

The final winding drive of the machine is derived from the primary drive shaft DS at sheave 50 which carries drive belt 51 over driving sheaves for winding rollers 19 and 20 and tension adjusting idler sheave 52.

Tension Control

Two independent tension control systems are provided to accommodate tension variations in the web W due to web stretch and start-stop acceleration cycles.

Figure 7:
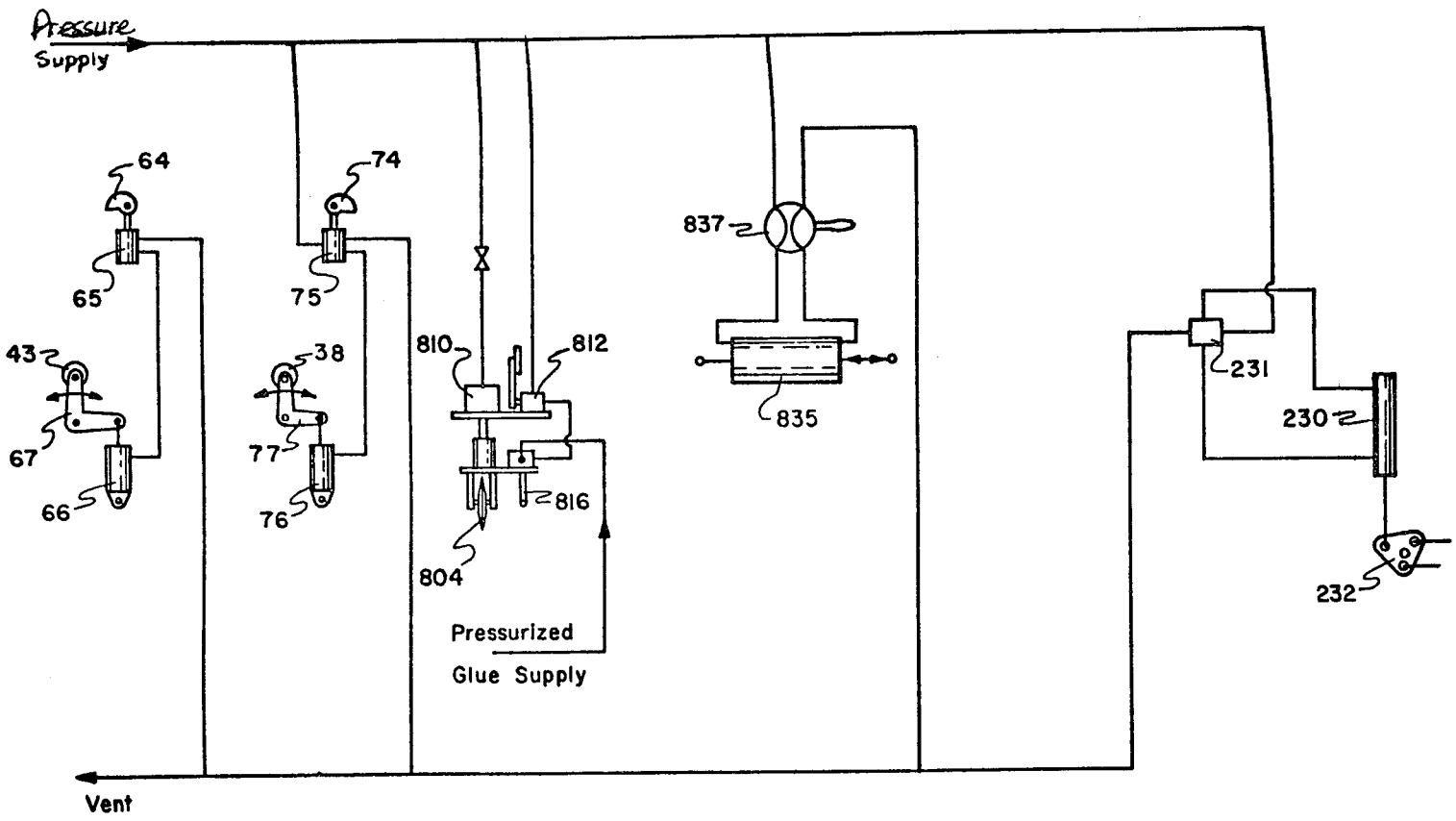
FIG. 7 is a conduit schematic of the several fluid pressure actuated elements of the invention.

The first or supply tension control system comprises the dancer roll 13 as a tension sensor. The predominant weight of dancer roll 13 is carried by a chain 61 wrapped over sprocket 63 and secured to counterbalance weight 62. Rotatively integral with the sprocket 63 is a cam 64 which strokes the adjustment spool of an air pressure regulator 65. The regulated pressure discharge of regulator 65 is connected (FIG. 7) to linear motor 66 which rotates bellcrank 67 proportionately. Shifting roller 43 is rotatively journaled to bellcrank 67 and rides against the surface of transmission belt 42.

Position adjustment of the shifting roller 43 momentarily alters the tension in belt 42.

Figure 3:
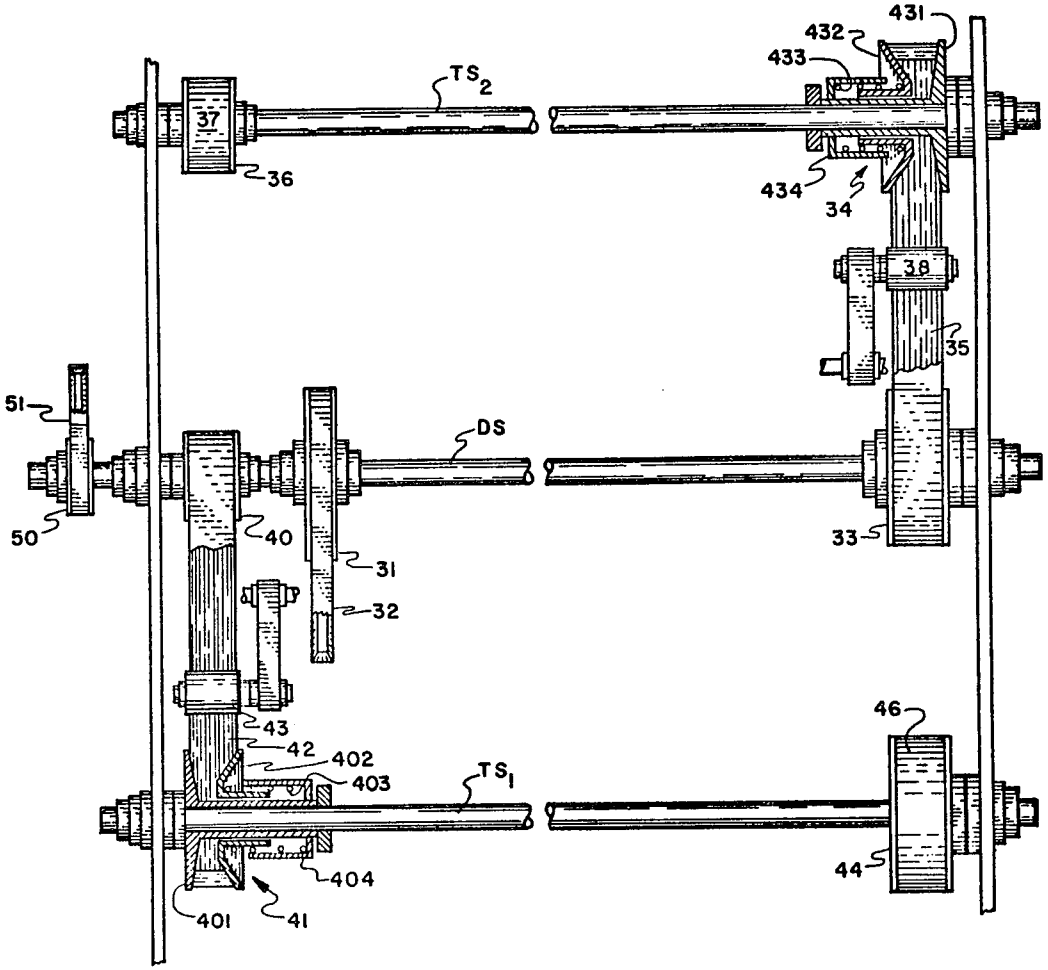
FIG. 3 is a partially sectioned plan of the primary drive shaft showing operative details of variable ratio belt transmissions utilized in the present invention.

Relative to FIG. 3, transmission sheave 41, which is driven by belt 42, comprises a fixed sheave cone 401 and an axially sliding cone 402. Coil spring 403 is bedded between a collar 404 and the sliding cone 402.

As the tension in belt 42 is altered by the shifting roller 43, sliding cone 402 shifts axially against or with the bias of spring 403 until a new equilibrium position for the belt 42 radius about the sheave 41 is established. As a consequence of the change in running radius or belt pitch for the belt 42 over the transmission sheave 41, the rotational ratio between the fixed pitch sheave 40 and the variable pitch sheave 41 is changed accordingly. The end result is a running speed change for the web W from the supply drum 10 and guide roll 11 which receive driving power through the transmission sheave 41.

The second tension control system in the web route is extended over guide rolls 14, 15 and 16 which effectively control the web tension onto the rewind reels 21. This second system is similar to the first in that the weight of dancer roll 18 is predominantly carried by counterweights 72 (FIG. 2) suspended on chain 71 over sprocket 73. Rotation of sprocket 73 turns cam 74 which strokes the regulator valve 75. Controlled pressure from the regulator 75 determines the positional set of linear motor 76 acting on bellcrank 77 which presses shifting roller 38 into the course of transmission belt 35.

The rotational ratio between fixed pitch sheave 33 and variable pitch sheave 34 is changed by the equilibrium balance achieved between the internal tension of belt 35 tending to draw the belt into the groove between fixed cone 431 (FIG. 3) and sliding cone 432 against the bias of spring 433 reacting on collar 434.

The resulting rotational speed of transmission sheave 34 is transmitted along shaft $TS_2$ to fixed pitch sheave 36 and finally to the drive of guide rolls 14, 15 and 16.

Drive Motor Control

Primary motor and speed control over the machine is exerted by means of two electrical pulse counting relays 91 which, per se, are well known in the prior art. Pulse generation is derived from a secondary drive sheave 53 secured to winding roller 20 which drives a belt 55 around pulsing wheel 54. When each of the uniformly spaced lobes of the pulsing wheel 54 crosses the flux field of magnetic proximity sensor 90, an electrical impulse is transmitted to the first counting relay 91. Consequently, a direct correlation may be established between the linear quantity of web material passing over the winding roll 20 and the number of pulses received by counting relay 91.

Operationally, the absolute number of pulses received by relay 91 in a reset interim is accumulated and the accumulation continuously compared to a set-point value SP1 which may be manually variable and calibrated in linear units. Until the pulse number accumulation reaches the SP1 value, a first or high motor M speed command value is transmitted by the relay 91 to the motor controller 94. When the total number of accumulated pulses from sensor 90 reaches the SP1 value, the first motor speed command ceases and the relay 91 transfers all subsequent pulses to counting relay 92.

Relay 92 is similar to 91 in that upon initially receiving pulses from sensor 90 via relay 91, a second or creep speed command signal is issued to motor controller 94. Also like relay 91, the total pulse accumulation by relay 92 is determined by variable set-point SP2. Upon reaching the SP2 value, the second speed command is terminated.

The counting interims of both relays 91 and 92 are simultaneously reset manually by a single control switch which erases the counting circuit memory of past pulse accumulation. This single switch is actuated by the machine operator to also start the motor M on a controlled length rewinding cycle.

For selective manual control over the motor M, a jog switch 93 is provided.

From the foregoing motor control description, it will be seen by those of skill in the art that a rewinding cycle may be started to continue at high speed for a certain percentage of the total length of web W to be wound upon reels 21, the period of high speed continuance being determined by SP1. Thereafter, the machine decelerates to the second or creep speed until the final web length on reels 21 is obtained as determined by SP2.

Mandrel Supply and Wind Start

Following completion of the two-stage winding cycle, the assembly comprising the entire line of reels 21 and mandrel 210 is lifted from contact with the driving rolls 19 and 20 and withdrawn from the mandrel confining channels 220 which bracket both ends of the mandrel 210 on opposite sides of the machine between oppositely facing webs 221 and flanges 222. Notches 223 in flanges 222 facilitate such removal.

When the reel and mandrel assembly is removed from the winding station, the web strips remain continuous from the slitter knives 18 across a portion of both driving roll surfaces 19 and 20 onto the reels 21. Consequently, the web strips span the rewinding station beneath a stack of empty mandrels **210*a* and 210*b***.

Figure 4:
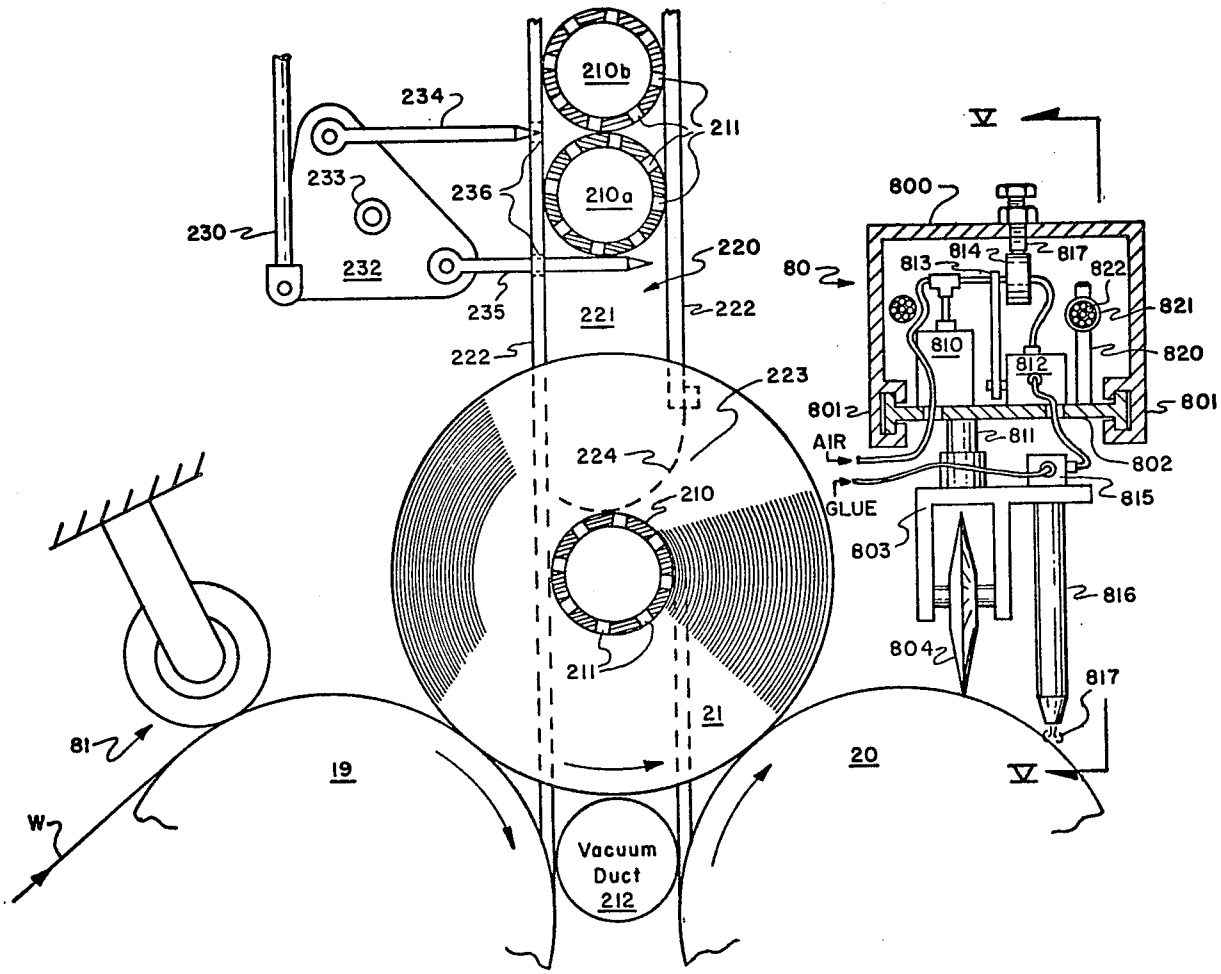
FIG. 4 is a sectional elevation of the rewinding station showing the transverse cutter-gluer apparatus and the mandrel feed mechanism.

As seen from FIG. 4, each core mandrel 210 is simply a length of cylindrical conduit perforated around the periphery and along the length thereof with a multiplicity of apertures 211. The extended height of channels 221 forms a magazine in which such stack of empty mandrels **210*a* and 210*b*** may be stored pending use.

When an empty mandrel is desired, motor mechanism 230 is stroked as by pressure reversal at a four-way valve 231 (FIG. 7) to rotate the bellcrank plate 232 about journal 233. Stop pins 234 and 235, also pivotally secured to the bellcrank plate 233, are guided through apertures 236 in the channel flange 222. As the motor 230 strokes from the lower stop position to the top, rotation of the bellcrank 232 withdraws stop pin 235 thereby allowing empty mandrel **210*a* to gravity fall across the continuous web strips spanning the winding cradle between drive rolls 19 and 20, the strips being confined by the weight of the empty mandrel against the stationary surface of drive rolls 19 and 20**.

A flexible flapper gate 224 spanning each of notches 223 in the channel flange 222 prevents the descending empty mandrel **210*a*** from escaping the channel confinement.

Simultaneous with the withdrawal of stop pin 235, pin 234 advances to obstruct the descension of mandrel **210*b***.

Immediately following release of the lowermost empty mandrel **210*a*, the motor mechanism is stroked back to the lower, starting position shown by FIG. 4 whereupon mandrel 210*b* descends to rest on the lower stop pin 36** until need for another empty mandrel initiates another cycle of the mechanism.

In axial alignment with the cradle resting position of empty mandrel **210*a* between drive rolls 19 and 20, a conduit aperture 212 is provided in either or both channels 220. Aperture 212 is connected to a vacuum source so that a radially inward draft of air is created through the mandrel apertures 211 when the hollow bore of an empty mandrel 210*a* aligns with the vacuum source aperture 212. This circumstance occurs only during the first few wraps of a web strip about a mandrel. With each successive wrap, the mandrel rises in the channel 220 to increase the misalignment between the channel bore and the vacuum aperture 212. Operatively, however, such mandrel and vacuum source misalignment at this stage of the reel building sequence is of no consequence since the objective of the vacuum induced draft through mandrel apertures 211** is to draw the loose, web strip ends that have been cut free from a preceding reel set to the mandrel surface and prevent relative slippage therebetween for the first few wraps. Thereafter, the unit integrity of the reel and mandrel is self-sustaining.

Transverse Cutting And Gluing

Figure 5:
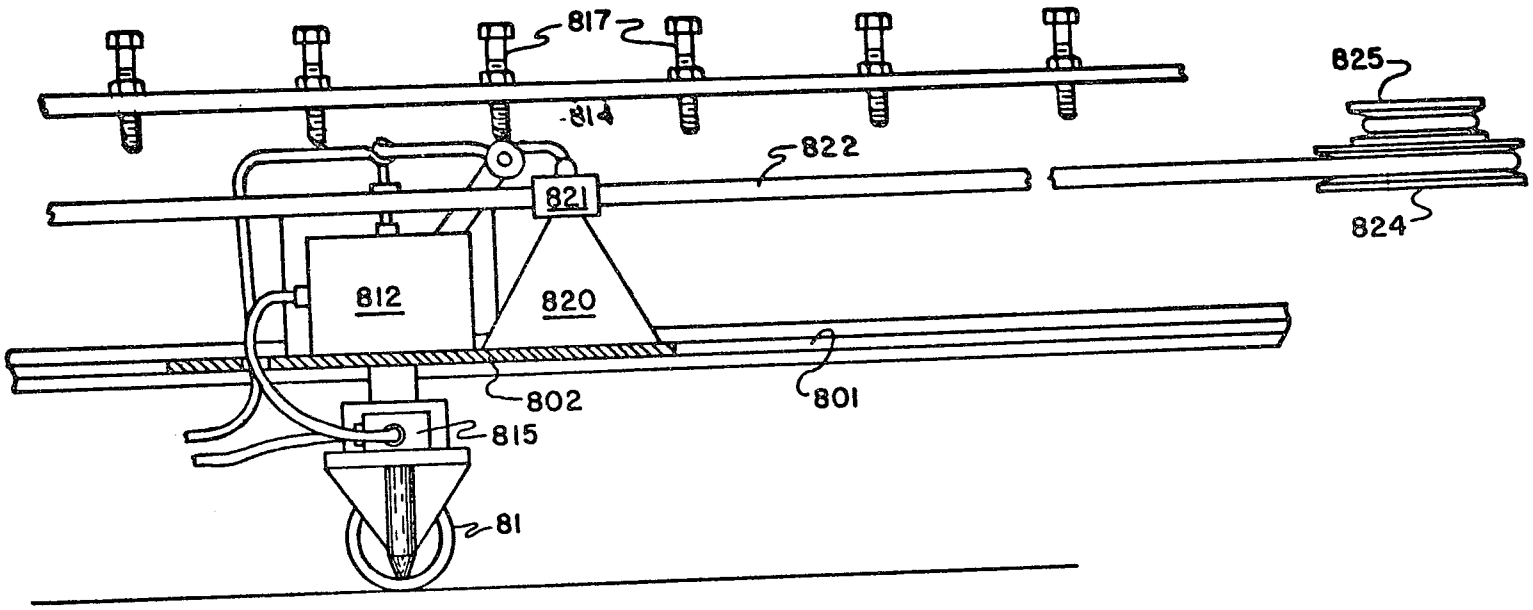
FIG. 5 is a sectional elevation of the cutter-gluer apparatus taken along cutting plane V—V of FIG. 4.

After a filled mandrel and reel assembly has been removed from the winding cradle position and an empty mandrel **210*a* dropped into the cradle, traversing head 80 is actuated to sever the several strips from the main body of the web. This mechanism is shown in detail by FIGS. 4 and 5 wherein a channel 800 disposed across the machine width provides a trackway 801 for carriage 802. Secured to the carriage 802 is the cylinder body 810 of a pneumatic ram 811 which projects beneath the carriage 802 to carry an axle frame 803 for a cutter wheel 804**.

Also secured to the axle frame is a pressurized adhesive pulsing valve 815 having a nozzle extension 816.

Valve 812, which is secured to the carriage 802, includes a spring biased activating arm 813 having a follower wheel 814 journaled thereto. Set screws 817 are positioned in the channel 800 along the traversal path of follower 814 to cause angular displacement of the actuating arm 813 as the carriage 802 is drawn along the channel 800 length. Longitudinal spacing of the set screws 817 corresponds to the width of reeled strips 21 so that a pulse of air pressure is dispatched to the adhesive valve 815 for discharge of a spot quantity of adhesive 817 on the cut tail of each reel strip 21.

Figure 6:
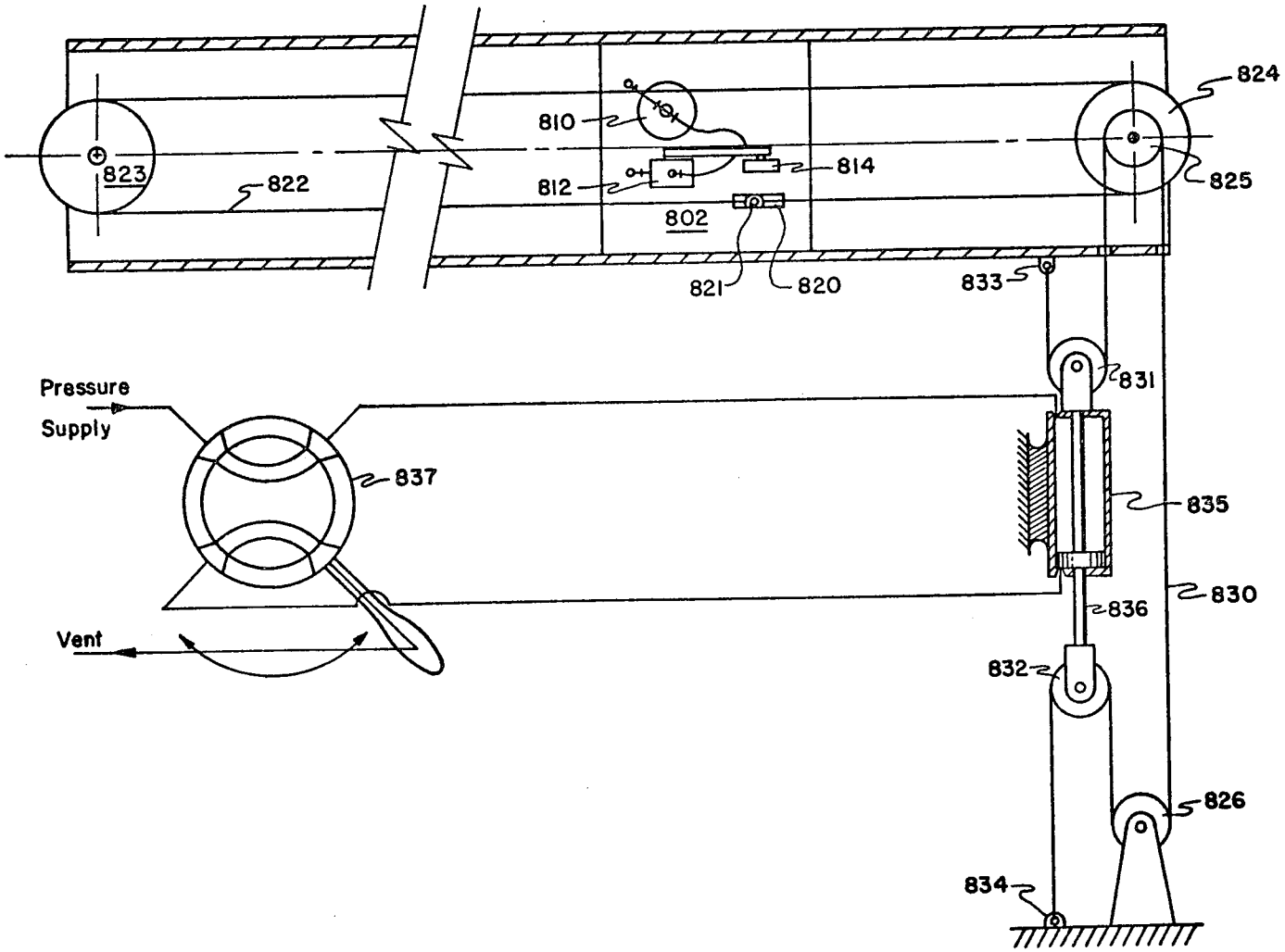
FIG. 6 is a schematic of the traversing drive mechanism for the cutter-gluer carriage.

The traversing mechanism for carriage 802 is best seen from FIG. 6 and basically comprises a cable 822 wrapped around an idler sheave 823 and a drive sheave 824. A pylon 820 secured to carriage 802 includes a cable clamp 821 for adjustably fixing the carriage longitudinally to the cable 822.

The drive sheave 824 is compounded with a smaller diameter sheave 825 which cooperates with a fixed idler sheave 826 to carry a transmission cable 830. Cable 830 has an open course between end fixture points 833 and 834, respectively. Intermediate of the fixture points and the sheaves 825 and 826, the transmission cable is routed over rod sheaves 831 and 832. Such rod sheaves are journaled to the respective rod ends of a double acting fluid motor 835. Four-way valve 837 directs pressurized air to either cylinder of the motor 835 for reversible displacement of the motor rod 836. Since the transmission cable 830 is of fixed length between the end fixtures 833 and 834, reciprocable displacement of the rod sheaves 831 and 832 causes translation of the transmission cable 830 over sheave 825 thereby rotatably driving sheave 824. The diameter ratio between compounded sheaves 824 and 825 is matched to the displacement ratio between the carriage 802 stroke length (machine width) and the stroke of fluid motor 835.

Actuation of the traversing head 80 is initiated by shifting the flow spool of four-way valve 837. This function may be performed manually by the operator after removal of a filled mandrel 210 from the winding cradle position. Thereafter, the glue-spotted tails of reels 21 are pressed into contact with the reel bodies to prevent unwinding. Since no mechanical link secures the reels 21 to a respective mandrel, little effort is required to manually strip the reels 21 from such mandrel 210 and return the stripped mandrel to the top of the magazine stack.

It will be understood by those of ordinary skill in the art that the mandrel release and traversing head actuating valves 231 and 837 may be provided with electrical or pneumatic operators. Moreover, the functioning of such powered actuating valves 231 and 837 may be coordinated with the motor control sequence by appropriate circuitry and components to effect continuous recycling.

Other obvious subcombination alternatives in the present invention may include the substitution of electrical or hydraulic linear motors in lieu of the pneumatic motors 66. Similarly, electrical or hydraulic controls may be substituted for the air pressure regulators 65 and 75 to link the dancer roll tension displacement to the transmission shifting mechanism. Specifically, a rotary potentiometer or rotationally variable electric resistance bank may be operatively secured to the axle shaft of the dancer roll sprocket 63 in lieu of the cam 64 and pressure regulator 65. Cooperatively, an electrically powered rotary actuator is substituted for the linear motor 66 and bellcrank 67 for the purpose of displacing the shifting roller 43 into the running course of transmission belt 42. The rotary actuator contemplated for this utility is of the type equipped with a feed-back circuit whereby each angular increment of the output shaft in an arc of less than 360° has an assigned electrical value. Consequently, each position of the dancer roll 13 is coordinated by the above described electro/mechanical control linkage to a corresponding rotational ratio between the primary power drive shaft DS and the transmission shaft $TS_1$.

Of course, this aforedescribed electric tension control system for the web supply circuit may also be adapted to the rewind circuit.

Additional obvious departures from the embodiment of my invention described herein will also be apparent to those of ordinary skill in the art. It is intended that such obvious departures be encompassed by the scope of my appended claims.

As my invention,

I claim:

1. A stretchable web material rewind machine comprising a plurality of web guide rolls along a web route between a material supply reel and a rewind reel, said plurality of guide rolls including a pair of S-wrap rolls, said supply reel being driven with an independent drive roll by means of a surface drive belt coursed about said drive roll and bearing against said web material on said supply reel, said independent drive roll and said S-wrap rolls being sheave belt driven, a rotational power source, first and second variable pitch diameter sheave belt drives connecting said power source with said independent drive roll and said S-wrap rolls, respectively, first dancer roll means predominantly supported by said web at a first set position in said web route between said supply reel and said S-wrap rolls and second dancer roll means predominantly supported by said web at a second set position in said web route between said S-wrap rolls and said rewind reel, first dancer roll position sensing means for increasing the variable pitch diameter of said first variable pitch sheave in proportional response to displacements of said first dancer roll in one direction from said first set position and decreasing said first sheave pitch diameter in proportional response to displacements of said first dancer roll in the other direction from said first set position; and, second dancer roll position sensing means for increasing the variable pitch diameter of said second variable pitch sheave in proportional response to displacements of said second dancer roll in one direction from said second set position and decreasing said second sheave pitch diameter in proportional response to displacements of said second dancer roll in the other direction from said second set position.

2. Apparatus as described by claim 1 wherein each of said variable pitch sheaves has an axially shifting sheave cone that is axially displaced against a resilient bias in response to tensile changes in the respective sheave belt.

3. Apparatus as described by claim 2 wherein said sheave belts are coursed over respective positionally shiftable idler sheave means, the position of said idler sheave means being controlled by respective control linkage means to correspondingly tension said belts.

4. Apparatus as described by claim 3 wherein each of said control linkage means comprises respective motor actuator means for positionally shifting said idler sheave means, said first and second dancer roll position sensing means comprising respective motor actuator control means mechanically linked to respective dancer roll means to uniquely coordinate a dancer roll position with a corresponding motor actuator means position.

* * * * *